US012535227B2

(12) United States Patent
Liao

(10) Patent No.: US 12,535,227 B2
(45) Date of Patent: Jan. 27, 2026

(54) SPLIT-TYPE RANGE HOOD HAVING GUIDING HOOK GROOVES FOR PRESSURE DISPERSION TRAY

(71) Applicant: BLUESKY COOKING STYLE CO., LTD., Taipei (TW)

(72) Inventor: Chin-Jung Liao, Taipei (TW)

(73) Assignee: BLUESKY COOKING STYLE CO., LTD., Taipei (TW)

( * ) Notice: Subject to any disclaimer, the term of this patent is extended or adjusted under 35 U.S.C. 154(b) by 397 days.

(21) Appl. No.: 18/243,722

(22) Filed: Sep. 8, 2023

(65) Prior Publication Data

US 2024/0167698 A1 May 23, 2024

(30) Foreign Application Priority Data

Nov. 21, 2022 (TW) ..... 111144342

(51) Int. Cl.
*F24C 15/20* (2006.01)

(52) U.S. Cl.
CPC ..... *F24C 15/2071* (2013.01)

(58) Field of Classification Search
CPC ..... F24C 15/2071; F24C 15/001; F24C 15/2035; F24C 15/20; F24C 15/2078; F24C 15/2085; F24C 15/2092; Y10S 55/36; F24F 13/084; A47F 5/116; A47F 5/0025; A47F 7/144
USPC ..... 454/67
See application file for complete search history.

(56) References Cited

FOREIGN PATENT DOCUMENTS

TW M625224 U * 4/2022 ..... F24H 9/2014

OTHER PUBLICATIONS

English translation of TW-M625224-U, dated Nov. 12, 2025 (Year: 2025).*

* cited by examiner

*Primary Examiner* — Edelmira Bosques
*Assistant Examiner* — Brett Peterson Mallon
(74) *Attorney, Agent, or Firm* — Li & Cai Intellectual Property (USA) Office

(57) ABSTRACT

A split-type range hood having guiding hook grooves for a pressure dispersion tray includes a range hood body and the pressure dispersion tray. The range hood body includes a chassis. A smoke collecting guide tank upwardly recesses from a bottom of the chassis. An inner wall of the smoke collecting guide tank has two guiding hook grooves that are spaced apart from each other. Each guiding hook groove has a trapezoidal opening and a left narrow slit and a right narrow slit extending outwardly from a bottom edge of the trapezoidal opening. A distance between the left narrow slit and the right narrow slit is defined as a length of each guiding hook groove. A frame of the pressure dispersion tray has two mounting hooks that are spaced apart from each other, and are capable of being movably snapped onto the guiding hook grooves.

6 Claims, 8 Drawing Sheets

SPLIT-TYPE RANGE HOOD HAVING GUIDING HOOK GROOVES FOR PRESSURE DISPERSION TRAY

CROSS-REFERENCE TO RELATED PATENT APPLICATION

This application claims the benefit of priority to Taiwan Patent Application No. 111144342, filed on Nov. 21, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a range hood, and more particularly to a split-type range hood having guiding hook grooves for a pressure dispersion tray.

BACKGROUND OF THE DISCLOSURE

The range hood is one of the common appliances in modern kitchens, and is mainly used for extracting and removing cooking fumes generated during the cooking process which may have adverse effects on the human body or the environment. Generally, the range hood is installed above the gas stove and other kitchen appliances to facilitate the extraction of grease and smoke that rise during the cooking process. Currently, range hoods having a pressure dispersion tray have the pressure dispersion tray disposed beneath a suction port, so that the rising smoke is first blocked by the pressure dispersion tray, and then flows into the suction port from two lateral sides of the pressure dispersion tray. However, a fixed-type pressure dispersion tray is incapable of absorbing more grease and smoke according to different positions of the gas stove for discharging air, such that a movable pressure dispersion tray was made available on the market, but the movable pressure dispersion tray still has problems of inconvenient mounting and dismounting, and poor guiding and positioning.

SUMMARY OF THE DISCLOSURE

In response to the above-referenced technical inadequacies, the present disclosure provides a split-type range hood having guiding hook grooves for a pressure dispersion tray.

In order to solve the above-mentioned problems, one of the technical aspects adopted by the present disclosure is to provide a split-type range hood. The split-type range hood includes a range hood body and a pressure dispersion tray. The range hood body includes a chassis. A smoke collecting guide tank is upwardly recessed from a bottom of the chassis, and the smoke collecting guide tank has a top wall and an inner wall connected to the top wall. The top wall of the smoke collecting guide tank has a rectangular suction opening, and the inner wall of the smoke collecting guide tank has two guiding hook grooves that are spaced apart from each other. Each of the two guiding hook grooves has a trapezoidal opening and a left narrow slit and a right narrow slit extending outwardly from a bottom edge of the trapezoidal opening, respectively, and a distance between the left narrow slit and the right narrow slit is defined as a length of each of the two guiding hook grooves. The pressure dispersion tray is disposed in the smoke collecting guide tank. The pressure dispersion tray has a base plate and a frame connected to the base plate, the frame of the pressure dispersion tray has two mounting hooks that are spaced apart from each other, and each of the two mounting hooks is capable of being movably snapped onto each of the two guiding hook grooves. Each of the two mounting hooks has a connection portion, a horizontal portion, and a hook portion, the connection portion is fixedly connected to the frame of the pressure dispersion tray, and the horizontal portion protrudes from the frame of the pressure dispersion tray and is parallel to the base plate of the pressure dispersion tray. A front end and a rear end of the horizontal portion are respectively connected to the hook portion and the connection portion. A left edge and a right edge of the horizontal portion are respectively tapered in a direction towards the front end of the horizontal portion to form a left guiding inclined edge and a right guiding inclined edge, so that a width of the horizontal portion between the left edge and the right edge is equal to the length of each of the two guiding hook grooves, and a width of the front end of the horizontal portion is less than the length of each of the two guiding hook grooves.

In one of the possible or preferred embodiments, the range hood body includes a smoke collecting box, the smoke collecting box is located on a top portion of the chassis and covers the rectangular suction opening, and a circular exhaust opening is formed on a top portion of the smoke collecting box and is in fluid communication with the rectangular suction opening.

In one of the possible or preferred embodiments, the top wall of the smoke collecting guide tank has two supporting pillars that extend downwardly and are spaced apart from each other, and a lower end of each of the two supporting pillars has a magnetic attraction member disposed thereon that is capable of being attached to the pressure dispersion tray.

In one of the possible or preferred embodiments, the connection portion, the horizontal portion, and the hook portion are formed by bending a metal plate.

In one of the possible or preferred embodiments, the width of the front end of the horizontal portion is greater than one-half of the length of each of the two guiding hook grooves.

In one of the possible or preferred embodiments, an angle between the hook portion and the horizontal portion is an acute angle of less than 90 degrees.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
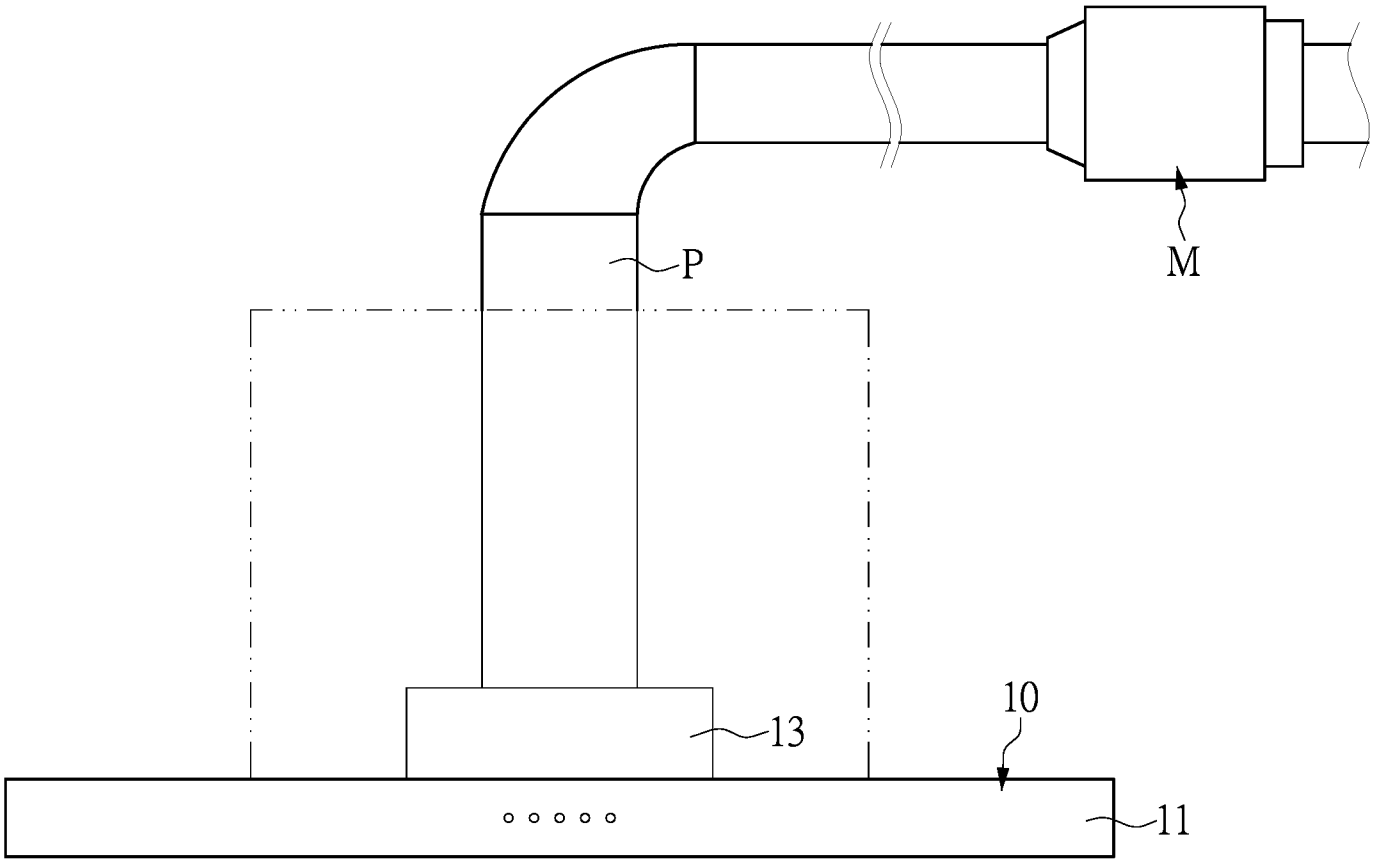
FIG. 1 is a schematic front view of a split-type range hood having guiding hook grooves for a pressure dispersion tray according to the present disclosure.
Figure 2:
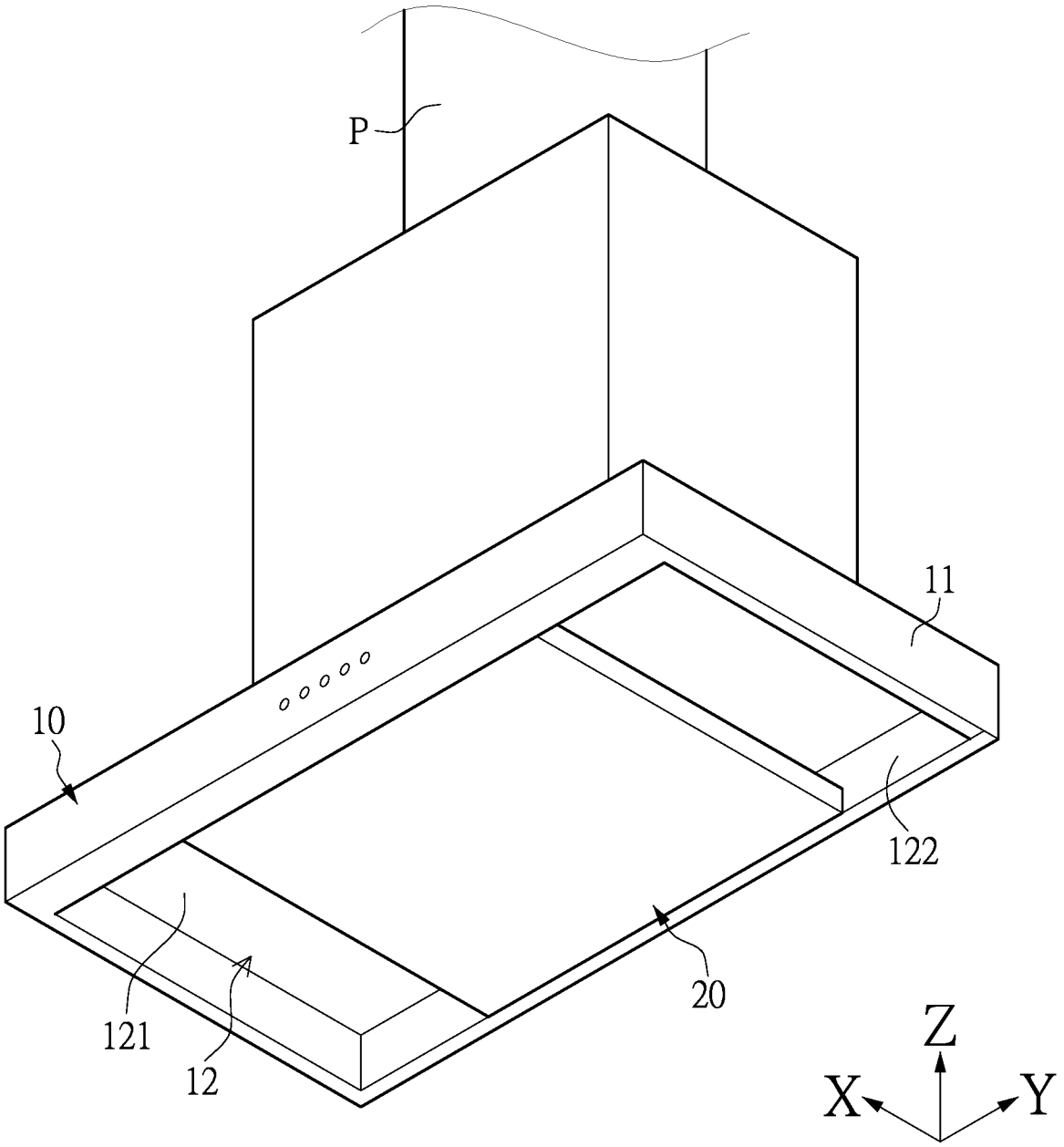
FIG. 2 is a schematic perspective view of the split-type range hood having the guiding hook grooves for the pressure dispersion tray according to the present disclosure.
Figure 3:
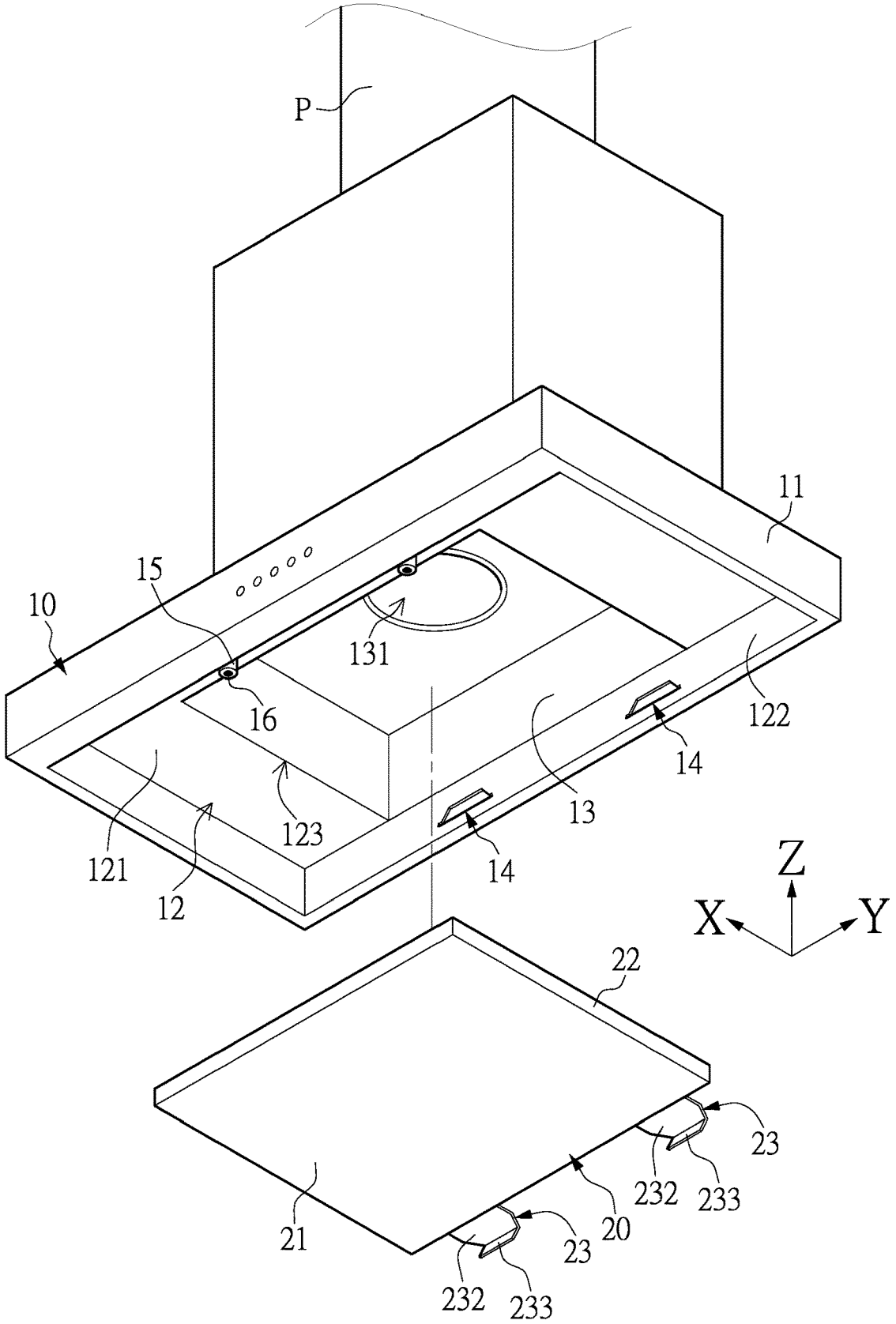
FIG. 3 is a schematic exploded view of the split-type range hood having the guiding hook grooves for the pressure dispersion tray according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 8, the present disclosure provides a split-type range hood having guiding hook grooves for a pressure dispersion tray that is referred to as a split-type range hood for the sake of brevity. The split-type range hood includes a range hood body 10 and a pressure dispersion tray 20 disposed in the range hood body 10. An exhaust fan M is disposed outside of the range hood body 10, and the split-type range hood can be connected to the exhaust fan M through an exhaust pipe P for outwardly discharging air.

In this embodiment, the range hood body 10 includes a chassis 11, a smoke collecting guide tank 12 that is elongated and is upwardly recessed from a bottom of the chassis 11, and the smoke collecting guide tank 12 has a top wall 121 and an inner wall 122 connected to the top wall 121. The top wall 121 of the smoke collecting guide tank 12 has a rectangular suction opening 123.

In this embodiment, the range hood body 10 further includes a smoke collecting box 13, the smoke collecting box 13 is located on a top portion of the chassis 11 and covers the rectangular suction opening 123, and a circular exhaust opening 131 is formed on a top portion of the smoke collecting box 13 so that the smoke collecting box 13 can be in fluid communication between the exhaust pipe P and the rectangular suction opening 123. A filter can be disposed inside of the smoke collecting box 13. The smoke collecting box 13 can provide a smooth surface, improve a smoothness of an air flow, and decrease a turbulence of cooking fumes, so that the cooking fumes can be more smoothly discharged outward by passing through the smoke collecting box 13. Furthermore, in the present disclosure, the exhaust fan M (also referred to as a split-type main fan) is moved out from the smoke collecting box 13, so that the exhaust fan M is not located inside the smoke collecting box 13. Accordingly, an indoor noise can be reduced and a height of the smoke collecting box 13 can be lowered, such that an indoor component of the split-type range hood can have reduced height, lighter weight, and a convenient mounting process.

The pressure dispersion tray 20 is disposed in the smoke collecting guide tank 12 and located below the rectangular suction opening 123. The pressure dispersion tray 20 can be suspended below the rectangular suction opening 123. Furthermore, the inner wall 122 of the smoke collecting guide tank 12 has two guiding hook grooves 14 that are spaced apart from each other. Each of the two guiding hook grooves 14 has a trapezoidal opening 141 and a left narrow slit 142 and a right narrow slit 143 extending outwardly from a bottom edge of the trapezoidal opening 141, respectively, and a distance between the left narrow slit 142 and the right narrow slit 143 is defined as a length L of each of the two guiding hook grooves 14.

The pressure dispersion tray 20 has a base plate 21 and a frame 22 connected to the base plate 21, the frame 22 of the pressure dispersion tray 20 has two mounting hooks 23 that are spaced apart from each other, and the two mounting hooks 23 are capable of being movably snapped onto the two guiding hook grooves 13. Furthermore, each of the two mounting hooks 23 has a connection portion 231, a horizontal portion 232, and a hook portion 233, the connection portion 231 is fixedly connected to the frame 22 of the pressure dispersion tray 20 by way of spot welding or riveting, and the horizontal portion 232 protrudes from the frame 22 of the pressure dispersion tray 20 and is parallel to the base plate 21 of the pressure dispersion tray 20. A front end and a rear end of the horizontal portion 232 are respectively connected to the hook portion 233 and the connection portion 231. The connection portion 231, the horizontal portion 232, and the hook portion 233 can be formed by bending a metal plate. A left edge and a right edge of the horizontal portion 232 are tapered in a direction towards the front end of the horizontal portion 232 to form a left guiding inclined edge 2321 and a right guiding inclined edge 2322, respectively, so that a width W1 of the horizontal portion 232 between the left edge and the right edge is equal to the length L of each of the two guiding hook grooves 14, and a width W2 of the front end of the horizontal portion 232 is less than the length L of each of the two guiding hook grooves 14. In addition, the width W2 of the front end of the horizontal portion 232 can be greater than one-half of the length L of each of the two guiding hook grooves 14.

Figure 7:
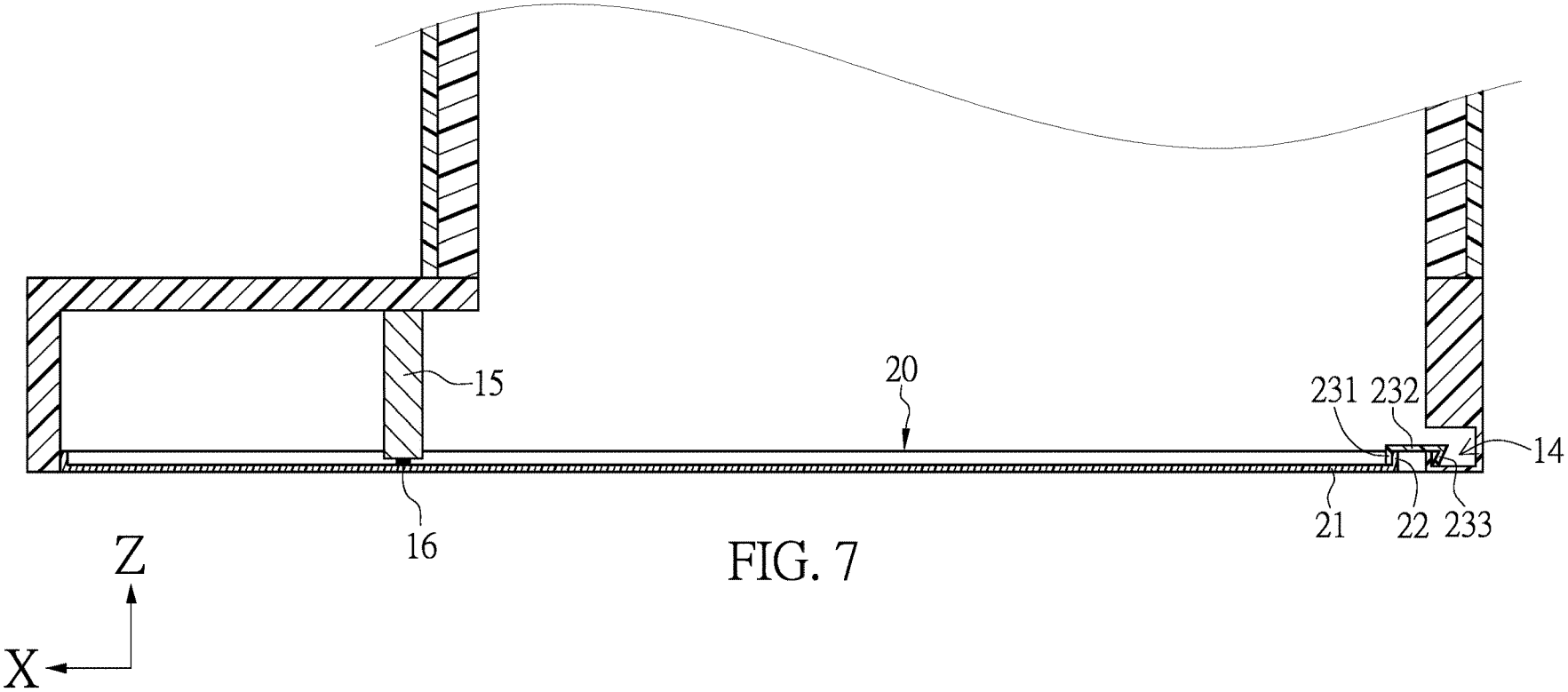
FIG. 7 is a schematic view of the pressure dispersion tray of the split-type range hood being horizontally arranged and moved forward according to the present disclosure.

Therefore, in this embodiment, by the structural design of the trapezoidal opening 141, the hook portion 233 of the mounting hook 23 can easily enter or be removed from the guiding hook groove 14. After the hook portion 233 of the mounting hook 23 enters the guiding hook groove 14 so that the pressure dispersion tray 20 is horizontally arranged (as shown in FIG. 7), by the structural design of the width W2 of the front end of the horizontal portion 232 being less than the length L of the guiding hook groove 14, the left guiding inclined edge 2321 or the right guiding inclined edge 2322 of the horizontal portion 232 can be horizontally moved into the left narrow slit 142 and the right narrow slit 143 along leftward or rightward directions (extension directions of Y-axis), respectively. Therefore, the pressure dispersion tray 20 can be moved leftward or rightward according to different positions of the gas stove for suctioning and discharging more cooking fumes. Furthermore, the horizontal portion 232 is unable to move along upward or downward directions (extension directions of Z-axis), so that the hook portion 233 of the mounting hook 23 can be prevented from coming off from the guiding hook groove 14 through the trapezoidal opening 141. Moreover, the left guiding inclined edge 2321 or the right guiding inclined edge 2322 of the horizontal portion 232 can be horizontally moved (e.g., moved from a position thereof shown in FIG. 7 to a position thereof shown in FIG. 8) along front and rear directions (extension directions of X-axis). By design of the width W1 of the horizontal portion 232 between the left edge and the right edge being equal to the length L of the guiding hook groove 14, the left edge and the right edge of the horizontal portion 232 can be respectively engaged to and abut against the left narrow slit 142 and the right narrow slit 143, so that the horizontal portion 232 is unable to move upwardly or downwardly, or move along the leftward or rightward directions. Therefore, the hook portion 233 of the mounting hook 23 can be prevented from coming off from the guiding hook groove 14 through the trapezoidal opening 141, and the pressure dispersion tray 20 can be centrically positioned.

In addition, the top wall 121 of the smoke collecting guide tank 12 further has two supporting pillars 15 that extend downwardly and are spaced apart from each other. A lower end of each of the two supporting pillars 15 has a magnetic attraction member 16 disposed thereon that is capable of being attached to the base plate 21 of the pressure dispersion tray 20 in a magnetic attraction manner or other manners such as an engaging manner, but the present disclosure is not limited thereto.

Figure 4:
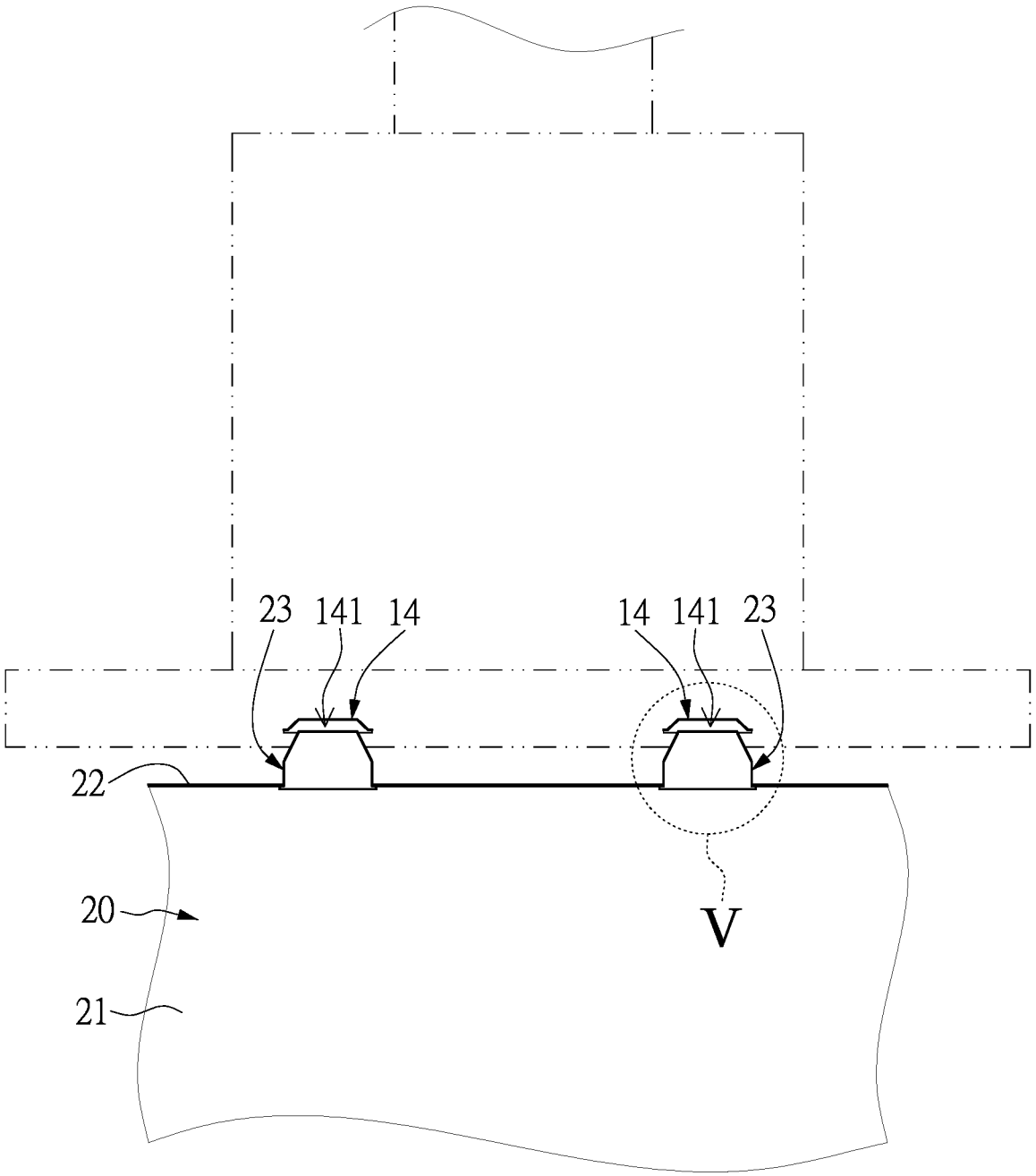
FIG. 4 is a schematic front view of the guiding hook grooves and the pressure dispersion tray of the split-type range hood according to the present disclosure.
Figure 5:
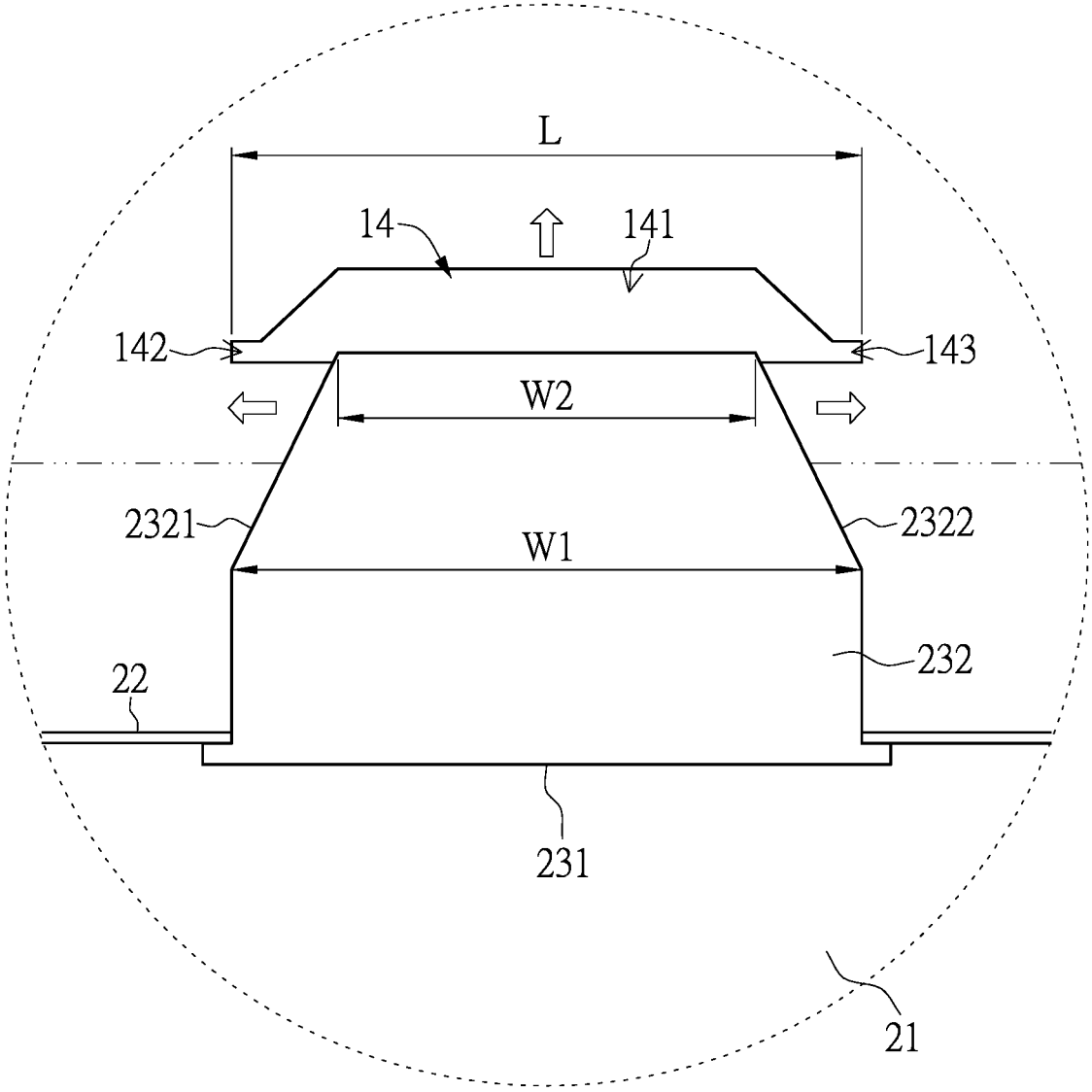
FIG. 5 is an schematic enlarged view of part V of FIG. 4.
Figure 6:
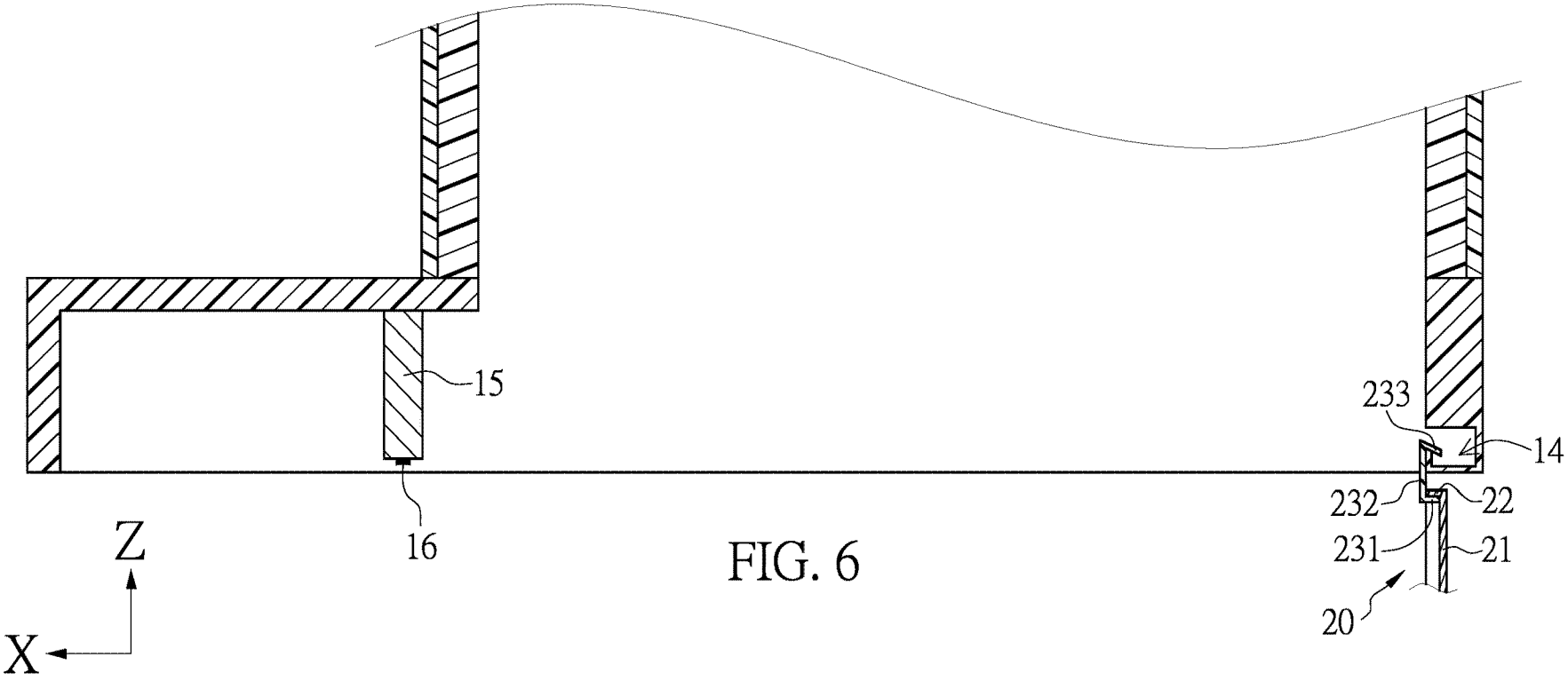
FIG. 6 is a schematic view of the pressure dispersion tray of the split-type range hood being vertically arranged and temporarily hooked on the guiding hook grooves according to the present disclosure.
Figure 8:
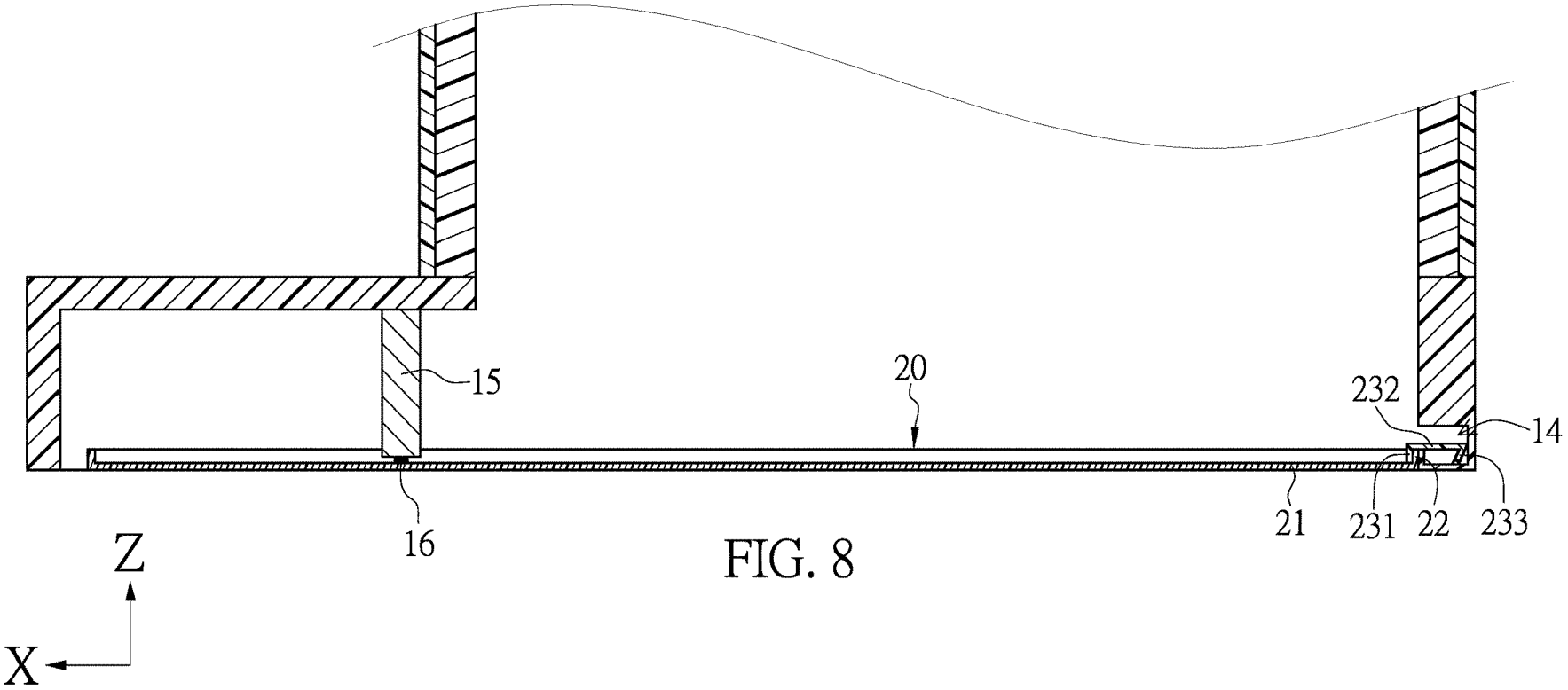
FIG. 8 is a schematic view of the pressure dispersion tray of the split-type range hood being horizontally arranged and moved rearward according to the present disclosure.

During cooking, if a gas stove below the split-type range hood is replaced from a single burner stove to a double burner stove or a triple burner stove, the pressure dispersion tray 20 can be moved along the leftward or rightward directions horizontally to correspond to different burner positions, so that the split-type range hood can suction more cooking fumes for discharging, and a range hood does not need to be replaced due to replacement of different gas stoves with different burner quantities or arrangements. Furthermore, when the pressure dispersion tray 20 requires cleaning, the pressure dispersion tray 20 can be horizontally moved along the forward and rearward directions (e.g., moved from the position as shown in FIG. 8 to the position as shown in FIG. 7), and the pressure dispersion tray 20 can then be pressed downward (as shown in FIG. 4 and FIG. 6). Therefore, the pressure dispersion tray 20 is vertically arranged and temporarily hooked on the guiding hook grooves 14 through the hook portion 233 of the mounting hook 23, and an angle between the hook portion 233 and the horizontal portion 232 of the mounting hook 23 is preferably an acute angle of less than 90 degrees. Then, the pressure dispersion tray 20 can be lifted upward so the hook portion 233 of the mounting hook 23 comes off from the guiding hook groove 14 through the trapezoidal opening 141, thereby facilitating the detaching and cleaning of the pressure dispersion tray 20.

In conclusion, in the split-type range hood having the guiding hook grooves for the pressure dispersion tray, by virtue of "the inner wall of the smoke collecting guide tank having two guiding hook grooves that are spaced apart from each other, each of the two guiding hook grooves having a trapezoidal opening and a left narrow slit and a right narrow slit extending outwardly from a bottom edge of the trapezoidal opening, respectively, and a distance between the left narrow slit and the right narrow slit being defined as a length of each of the two guiding hook grooves," "the pressure dispersion tray having a base plate and a frame connected to the base plate, the frame of the pressure dispersion tray having two mounting hooks that are spaced apart from each other, and each of the two mounting hooks being capable of being movably snapped onto each of the two guiding hook grooves," and "each of the two mounting hooks having a connection portion, a horizontal portion, and a hook portion, the connection portion being fixedly connected to the frame of the pressure dispersion tray, and the horizontal portion protruding from the frame of the pressure dispersion tray and being parallel to the base plate of the pressure dispersion tray; a front end and a rear end of the horizontal portion being respectively connected to the hook portion and the connection portion; a left edge and a right edge of the horizontal portion being respectively tapered in a direction towards the front end of the horizontal portion to form a left guiding inclined edge and a right guiding inclined edge, so that a width of the horizontal portion between the left edge and the right edge is equal to the length of each of the two guiding hook grooves, and a width of the front end of the horizontal portion is less than the length of each of the two guiding hook grooves," the mounting and detaching operations of the pressure dispersion tray can be greatly improved in convenience, and the guiding and positioning of the pressure dispersion tray can be achieved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A split-type range hood, comprising:

a range hood body including a chassis, wherein a smoke collecting guide tank is upwardly recessed from a bottom of the chassis, and the smoke collecting guide tank has a top wall and an inner wall connected to the top wall; wherein the top wall of the smoke collecting guide tank has a rectangular suction opening, and the inner wall of the smoke collecting guide tank has two guiding hook grooves that are spaced apart from each other; wherein each of the two guiding hook grooves has a trapezoidal opening and a left narrow slit and a right narrow slit extending outwardly from a bottom edge of the trapezoidal opening, respectively, and a distance between the left narrow slit and the right narrow slit is defined as a length of each of the two guiding hook grooves; and a pressure dispersion tray disposed in the smoke collecting guide tank, wherein the pressure dispersion tray has a base plate and a frame connected to the base plate, the frame of the pressure dispersion tray has two mounting hooks that are spaced apart from each other, and each of the two mounting hooks is capable of being movably snapped onto each of the two guiding hook grooves; wherein each of the two mounting hooks has a connection portion, a horizontal portion, and a hook portion, the connection portion is fixedly connected to the frame of the pressure dispersion tray, and the horizontal portion protrudes from the frame of the pressure dispersion tray and is parallel to the base plate of the pressure dispersion tray; wherein a front end and a rear end of the horizontal portion are respectively connected to the hook portion and the connection portion; wherein a left edge and a right edge of the horizontal portion are tapered in a direction towards the front end of the horizontal portion to form a left guiding inclined edge and a right guiding inclined edge, respectively, so that a width of the horizontal portion between the left edge and the right edge is equal to the length of each of the two guiding hook grooves, and a width of the front end of the horizontal portion is less than the length of each of the two guiding hook grooves.

2. The split-type range hood according to claim 1, wherein the range hood body includes a smoke collecting box, the smoke collecting box is located on a top portion of the chassis and covers the rectangular suction opening, and a circular exhaust opening is formed on a top portion of the smoke collecting box and is in fluid communication with the rectangular suction opening.

3. The split-type range hood according to claim 1, wherein the top wall of the smoke collecting guide tank has two supporting pillars that extend downwardly and are spaced apart from each other, and a lower end of each of the two supporting pillars has a magnetic attraction member disposed thereon that is capable of being attached to the pressure dispersion tray.

4. The split-type range hood according to claim 1, wherein the connection portion, the horizontal portion, and the hook portion are formed by bending a metal plate.

5. The split-type range hood according to claim 1, wherein the width of the front end of the horizontal portion is greater than one-half of the length of each of the two guiding hook grooves.

6. The split-type range hood according to claim 1, wherein an angle between the hook portion and the horizontal portion is an acute angle of less than 90 degrees.

* * * * *